US008720420B2

(12) United States Patent
Lombard

(10) Patent No.: US 8,720,420 B2
(45) Date of Patent: May 13, 2014

(54) ENGINE ARRANGEMENT COMPRISING A HEAT RECOVERY CIRCUIT

(75) Inventor: Benoit Lombard, Lyons (FR)

(73) Assignee: Renault Trucks, St. Priest (FR)

( * ) Notice: Subject to any disclaimer, the term of this patent is extended or adjusted under 35 U.S.C. 154(b) by 0 days.

(21) Appl. No.: 13/699,735

(22) PCT Filed: Aug. 27, 2010

(86) PCT No.: PCT/IB2010/002405
§ 371 (c)(1),
(2), (4) Date: Nov. 25, 2012

(87) PCT Pub. No.: WO2012/025775
PCT Pub. Date: Mar. 1, 2012

(65) Prior Publication Data
US 2013/0139783 A1 Jun. 6, 2013

(51) Int. Cl.
*F02G 5/00* (2006.01)

(52) U.S. Cl.
USPC ..... 123/557; 123/1 A

(58) Field of Classification Search
USPC ..... 123/25 A, 1 A, 2, 3, 557, 558, 523, 549
See application file for complete search history.

(56) References Cited

U.S. PATENT DOCUMENTS

| | | | | |
|---|---|---|---|---|
| 4,235,077 | A | 11/1980 | Bryant | |
| 4,526,155 | A * | 7/1985 | van den Wildenberg et al. | 123/525 |
| 4,901,531 | A | 2/1990 | Kubo et al. | |
| 5,182,913 | A | 2/1993 | Robar et al. | |
| 6,186,126 | B1 * | 2/2001 | Gray, Jr. | 123/557 |

OTHER PUBLICATIONS

International Search Report (Oct. 4, 2011) for corresponding International Application PCT/IB2010/002405.

* cited by examiner

*Primary Examiner* — Hung Q Nguyen
(74) *Attorney, Agent, or Firm* — WRB-IP LLP

(57) ABSTRACT

An engine arrangement includes an internal combustion engine supplied with fuel by at least one fuel pump, a heat recovery circuit carrying a fluid in a loop, successively through the fuel pump, an evaporator, and an expander capable of generating power from the fluid expansion.

21 Claims, 3 Drawing Sheets

ENGINE ARRANGEMENT COMPRISING A HEAT RECOVERY CIRCUIT

BACKGROUND AND SUMMARY

The present invention relates to an engine arrangement comprising a heat recovery circuit for recovering energy, especially but not exclusively in a vehicle.

For many years, attempts have been made to improve vehicle efficiency, and more particularly the engine efficiency, which has a direct impact on fuel consumption.

One conventional system is to provide the engine arrangement with a heat recovery circuit for recovering part of the energy which is otherwise wasted in the form of heat in the exhaust gases, in the engine cooling circuit, in the lubricating circuit, etc. Such heat recovery circuits include Rankine circuits in which a fluid flows in a closed loop and undergoes successive processes according, to the Rankine thermodynamic cycle:

the working fluid, which is a liquid at this stage, is pumped from low to high pressure;

the high pressure liquid is evaporated into a has by a hot fluid flowing in another circuit of the engine arrangement;

the gas is expanded in an expander;

finally, the gas is condensed.

As a result, at least part of the thermal energy of the hot fluid used to evaporate the heat recovery fluid is recovered in the expander, for example under the form of mechanical, hydraulic, pneumatic or electrical energy. This thermal energy would otherwise be lost.

However, the provision of a heat recovery circuit involves the implementation of additional lines and components, which requires space and brings weight and cost.

It therefore appears that, from several standpoints, there is room for improvement in engine arrangements.

It is desirable to provide an improved engine arrangement comprising a heat recovery circuit which can overcome the drawbacks encountered in conventional such engine arrangements.

According to an aspect of the invention such an engine arrangement comprises:

an internal combustion engine where a combustion chamber is supplied with at least one combustion fluid by means of at least one combustion fluid circuit comprising at least one combustion fluid pump;

a heat recovery circuit carrying a fluid in a loop, successively through at least a pump, an evaporator, an expander capable of generating power from the fluid expansion, and a condenser, characterized in that the combustion fluid is used as the fluid in the heat recovery circuit and in that the combustion fluid pump is a common pump located in the heat recovery circuit to pressurize the fluid in the heat recovery circuit.

Thus, in an engine arrangement according to the invention, the heat recovery circuit does, in most cases, not comprise a dedicated pump, the fluid flowing in the heat recovery circuit being pumped from low to high pressure by a pump which is already provided for other purposes, i.e. the combustion fluid pump. Of course, there remains the possibility to provide a further pump in the heat recovery circuit, for example for further elevating the pressure level of the fluid in that circuit. Therefore, thanks to the invention, there can be provided an engine arrangement including a heat recovery circuit for recovering, energy which requires one pump less than in such engine arrangements of the prior art. This results in an engine arrangement which is more compact and less expensive.

It also contributes to a better overall engine efficiency as it spares driving a pump which would otherwise require a fraction of the engine's work.

in concrete terms, the heat recovery circuit is coupled to the combustion fluid circuit, and the same fluid flows, for example from a combustion fluid tank, to the engine and to the heat recovery circuit. Thus, said fluid must be both capable of playing its role in the combustion process in the engine and capable of undergoing the successive processes of a heat recovery cycle. As a result, a flow of combustion fluid flows through the common pump and is later divided into at least two flows, one directed to the combustion chamber and the other directed to the heat recovery circuit.

According to an embodiment, the engine arrangement comprises a low pressure combustion fluid pump and a high pressure combustion fluid pump, the common pump for the combustion fluid circuit and for the heat recovery circuit being the low pressure combustion pump. This applies in particular when the combustion fluid is fuel and where the internal combustion engine is a direct injection engine, either of the compression ignition type such as diesel engines, or of the spark-ignition type, were the fuel pressure after the low pressure pump can be around 3-5 bar. Of course, the engine arrangement may comprise a combustion fluid circuit having a single combustion fluid pump, which is then the common pump.

In any case, the engine arrangement may have several combustion fluid circuits, for example for separately injecting in the combustion chamber two or more fuels, or for injecting fuel and water, or for injection fuel and another type of additive such as an anti-knocking agent. In such case, each combustion fluid circuit may have its own pump and any one of the pumps can be the common pump shared with the heat recovery circuit.

According to a further feature, the heat recovery circuit may further comprise pressure reducing means between the common pump and the evaporator. This may apply in particular to spark ignition engines of the indirect injection type, which are supplied with fuel, such as gasoline, ethanol, methanol, liquid petroleum gas, natural gas or blends thereof. In such engines, fuel is injected in an intake manifold at around 30 bars. Therefore, the fuel pump is capable of raising the fuel pressure to around 30 bar. Then, the heat recovery circuit may require lower pressures for operating optimally, hence the usefulness of providing pressure reducing means being designed to lower the fuel pressure, for example to around 5-10 bar, in the heat recovery circuit.

The combustion fluid which is used as the fluid in the heat recovery circuit may comprise one of or a mixture of an alcohol such as methanol or ethanol;

a lower alkane amidst methane, ethane, propane or butane;

water, dimethyl ether (DME)

ammonia-water solution.

Such fluids are known to be used already either as a fuel, a fuel component or as another combustion fluid component in internal combustion engines, and as a fluid in a heat recovery circuit.

The fluid flowing in the heat recovery circuit evaporated in the evaporator by a hot fluid which can be chosen among:

a coolant of the engine flowing in a coolant circuit downstream from the engine—which therefore has a high temperature;

hot exhaust gases flowing in an exhaust line of the engine arrangement;

engine oil;

compressed intake air of the engine—i.e. hot gases downstream from the compressor;

EGR (exhaust gas recirculation) gases.

For example, the expander in the heat recovery circuit can be chosen among a turbine, a scroll, a screw and a piston.

In an implementation of the invention, the heat recovery circuit may further comprise a heater, also called regenerator, located downstream from the pump and upstream from the evaporator, said heater being designed to preheat the fluid flowing in the heat recovery circuit before it enters the evaporator by means of the fluid flowing in the heat recovery circuit downstream from the expander and upstream from the condenser. Indeed, the fluid which has been expanded has lost thermal energy but nevertheless its temperature remains high enough to preheat the fluid before it enters the evaporator.

The engine arrangement advantageously comprises means capable of recovering the energy produced by the heat recovery fluid expansion in the expander into mechanical energy on the engine crankshaft, into electricity and/or into hydraulic or pneumatic pressure. The mechanical energy can be recovered on the engine crankshaft directly or via intermediate parts such as gears. As regards electricity, it can be produced by means of an alternator coupled to a turbine as the expander. Electricity can be used in a hybrid vehicle (i.e. a vehicle powered by an internal combustion engine and an electric, motor) or in a conventional vehicle to charge a battery, to power auxiliaries, etc.

According to another aspect, the invention relates to a vehicle which comprises an engine arrangement as previously described.

However, the invention may also be used in other applications, for example in fixed industrial systems such as engine arrangements driving fixed electric generators.

These and other features and advantages will become apparent upon reading the following description in view of the drawing attached hereto representing, as non-limiting examples, embodiments of an engine arrangement according to the invention.

BRIEF DESCRIPTION OF THE DRAWINGS

The following detailed description of several embodiments of the invention is better understood when read in conjunction with the appended drawings being understood, however, that the invention is not limited to the specific embodiments disclosed.

DETAILED DESCRIPTION

Figure 1:
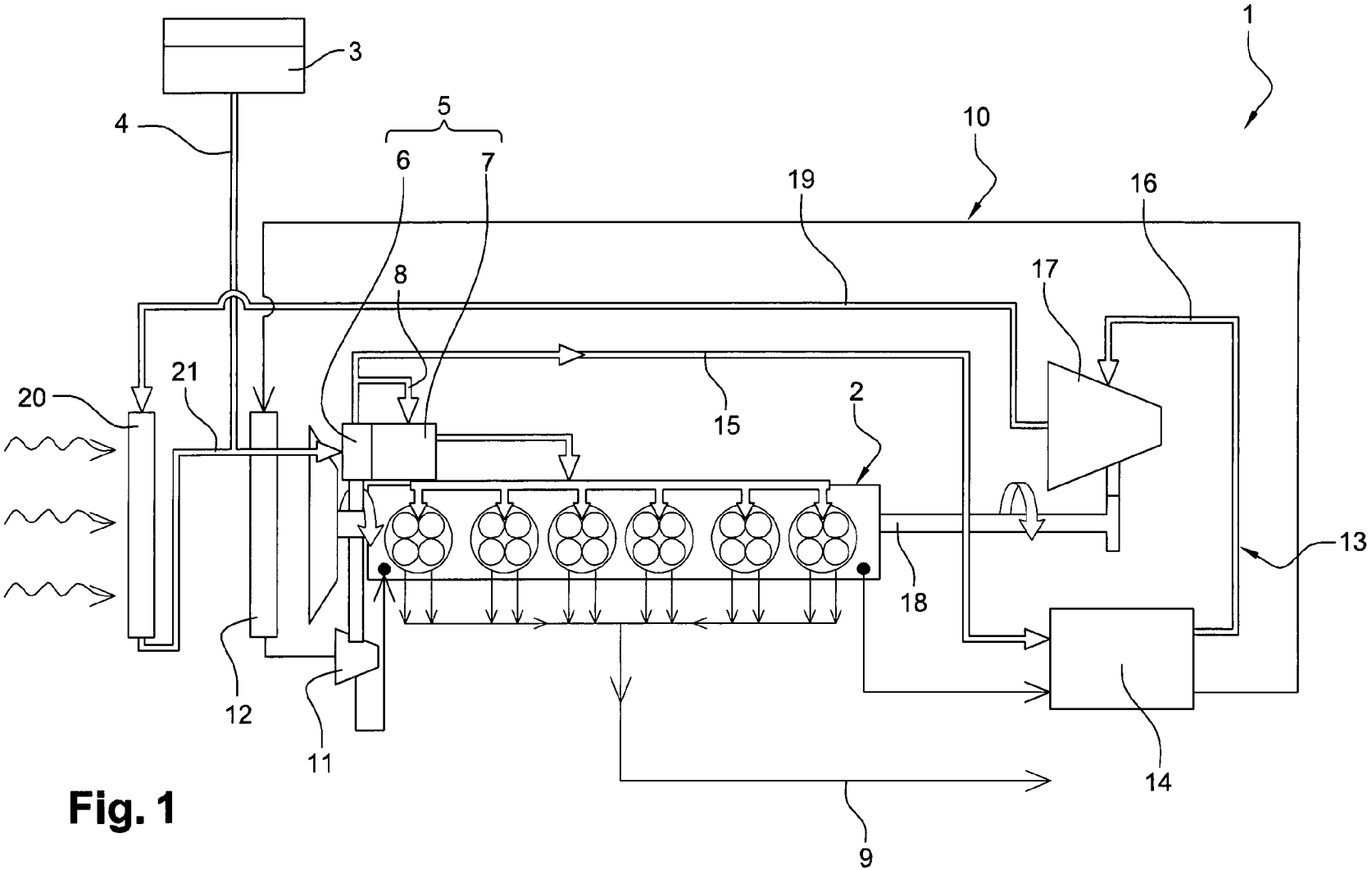
FIG. 1 is a schematic drawing of a first embodiment of an engine arrangement according to the invention.

The invention relates to an engine arrangement 1, two embodiments of which are illustrated in the figures.

The engine arrangement 1 comprises an internal combustion engine 2 which can be a diesel engine or a spark ignition engine. The engine 2, is supplied with fuel stored in a fuel tank 3 through a supply line 4 carrying said fuel towards a fuel pump 5 designed to provide fuel to the engine 2 where it can be injected, directly or indirectly, in a combustion chamber. In the illustrated embodiments, said fuel pump 5 comprises:

- a low pressure fuel pump 6 which is designed to raise the fuel pressure to around 3-5 bar,
- and a subsequent high pressure fuel pump 7 which is fed with fuel flowing out of the low pressure fuel pump 6 in a connecting line 8, and which is designed to raise the fuel pressure up to 200 bar or even up to 3000 bar, depending on the applications.

According to an embodiment of the invention, the fuel comprises ethanol. For example, it can be a pure ethanol or mixture of ethanol with gasoline or with water, with for example 15% gasoline and 85% ethanol. Other heat recovery compatible fuels, i.e. which could also be used as the working fluid in a heat recovery cycle, include fuels based on lower alkanes such as methane, ethane, propane or butane or mixtures thereof. Such fuels comprise widely used fuels such as natural gas, liquid petroleum gas (LPG), biogas, etc. . . . .

Exhaust gases are then collected and carried towards the atmosphere by an exhaust line 9 which usually comprises several gas treatment or filtering devices (not shown).

The engine arrangement 1 may further comprise a coolant circuit 10 carrying an engine coolant such as a water based liquid. The coolant is moved in a closed loop by means of a pump 11. The coolant enters the engine 2 in order to lower the engine temperature, thereby getting hotter. Then, downstream from the engine 2, the coolant is carried towards a radiator 12 where it is cooled down before entering the engine 2 again.

The engine arrangement 1 also comprises a heat recovery circuit 13 which allows some energy recovery, which, in the shown example, is based on the Rankine cycle.

The Rankine circuit 13 forms a closed loop which, in this example, is coupled to the circuit carrying fuel to the engine 2, and carries said fuel as the Rankine fluid.

Figure 3:
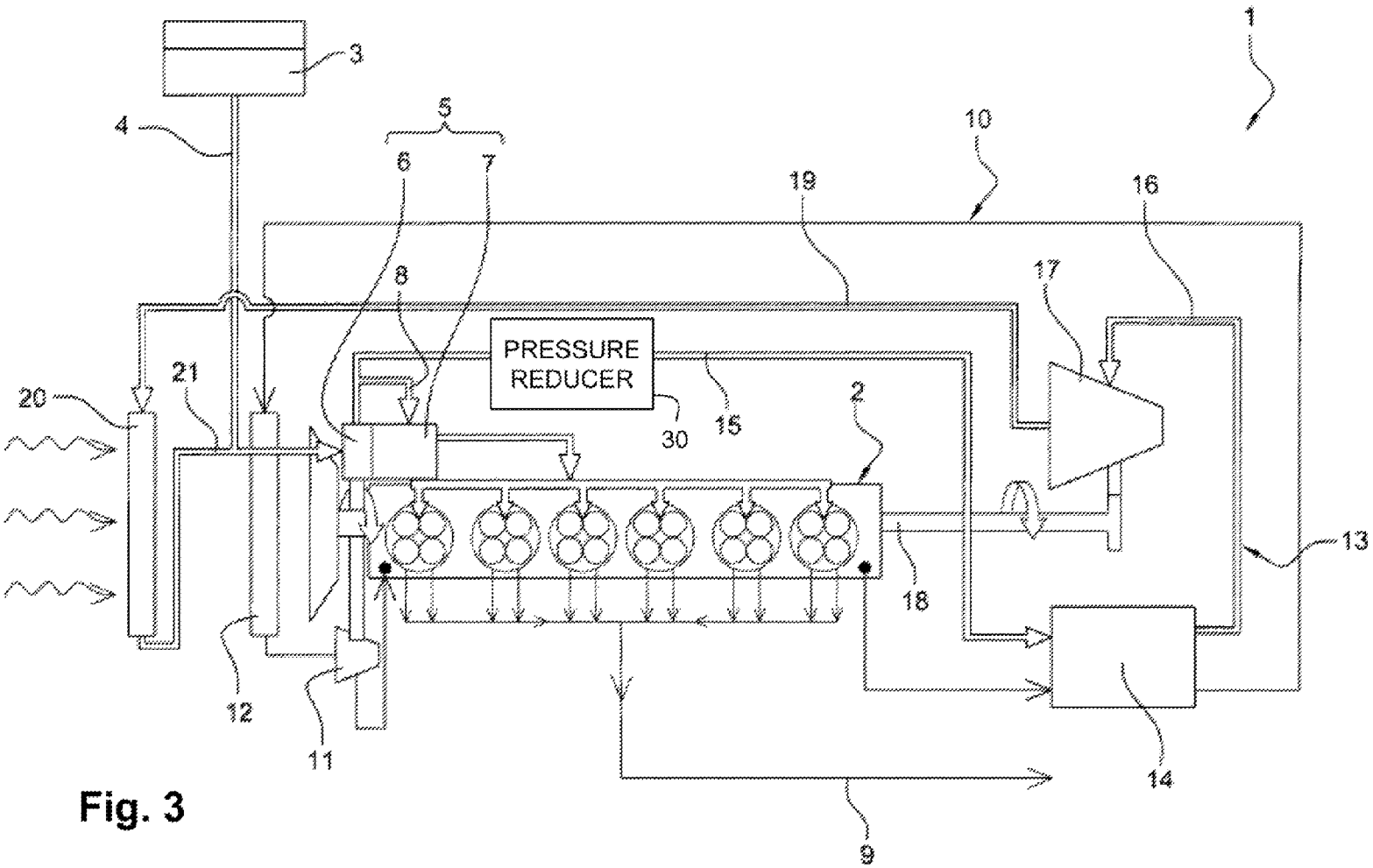
FIG. 3 is a schematic drawing of a third embodiment of an engine arrangement according to the invention.

From the supply line 4, the fuel enters the low pressure fuel pump 6 where it is pressurized and then is carried towards an evaporator 14 by a first line 15 branching from the connecting line 8. In other words, the low pressure fuel pump 6 acts as the Rankine pump, no other dedicated pump being provided to pump the Rankine fluid. All of the fuel flowing in the supply line 4 enters the low pressure fuel pump 6, but only part of this fuel is then injected in the engine by means of the high pressure fuel pump 7, whereas another part of this fuel will flow in the Rankine circuit 13. At this point, any excess fluid pressurized by pump 5 could be returned to the tank through a non shown connection. The heat recovery circuit may further comprise a pressure reducer 30 between the pump 6 and the evaporator 14 as seen in FIG. 3.

In the evaporator 14, the pressurized fuel is evaporated into a gas which then flows through a second line 16 towards an expander 17. In the illustrated embodiments, the expander is a turbine 17 which is capable of recovering the energy of the hot gas into mechanical energy. Said mechanical energy can be used on the engine crankshaft 18, by an alternator (not shown) coupled to the turbine 17 to produce electricity, and/or by a pump or by a compressor, to circulate and/or pressurize a fluid. Electricity can be used in a hybrid vehicle (i.e. a vehicle powered by an internal combustion engine and an electric motor) or in a conventional vehicle to charge a battery, to power auxiliaries, etc.

Downstream from the turbine 17, the gas, which has been expanded and cooled, flows in a third line 19 towards a condenser 20 in which it becomes a liquid again. In case the engine arrangement 1 is implemented on a vehicle, said condenser 20 is typically located on the front face of the vehicle. Downstream from the condenser 20, the liquid fuel is carried by a fourth line 21 which comes out into the supply line 4 before entering the low pressure fuel pump 6 with some more fuel coming from the fuel tank 3. Alternatively, the Rankine fluid flowing out of the condenser 20 could be directed to the tank 3.

A first embodiment of the invention is now described with reference to FIG. 1

In this embodiment, the fuel flowing in the Rankine circuit 13 is evaporated in the evaporator 14 by the coolant flowing in the coolant circuit 10 downstream from the engine 2. Indeed, said coolant has been heated when passing through the engine 2, and its temperature is high enough to evaporate the fuel.

Figure 2:
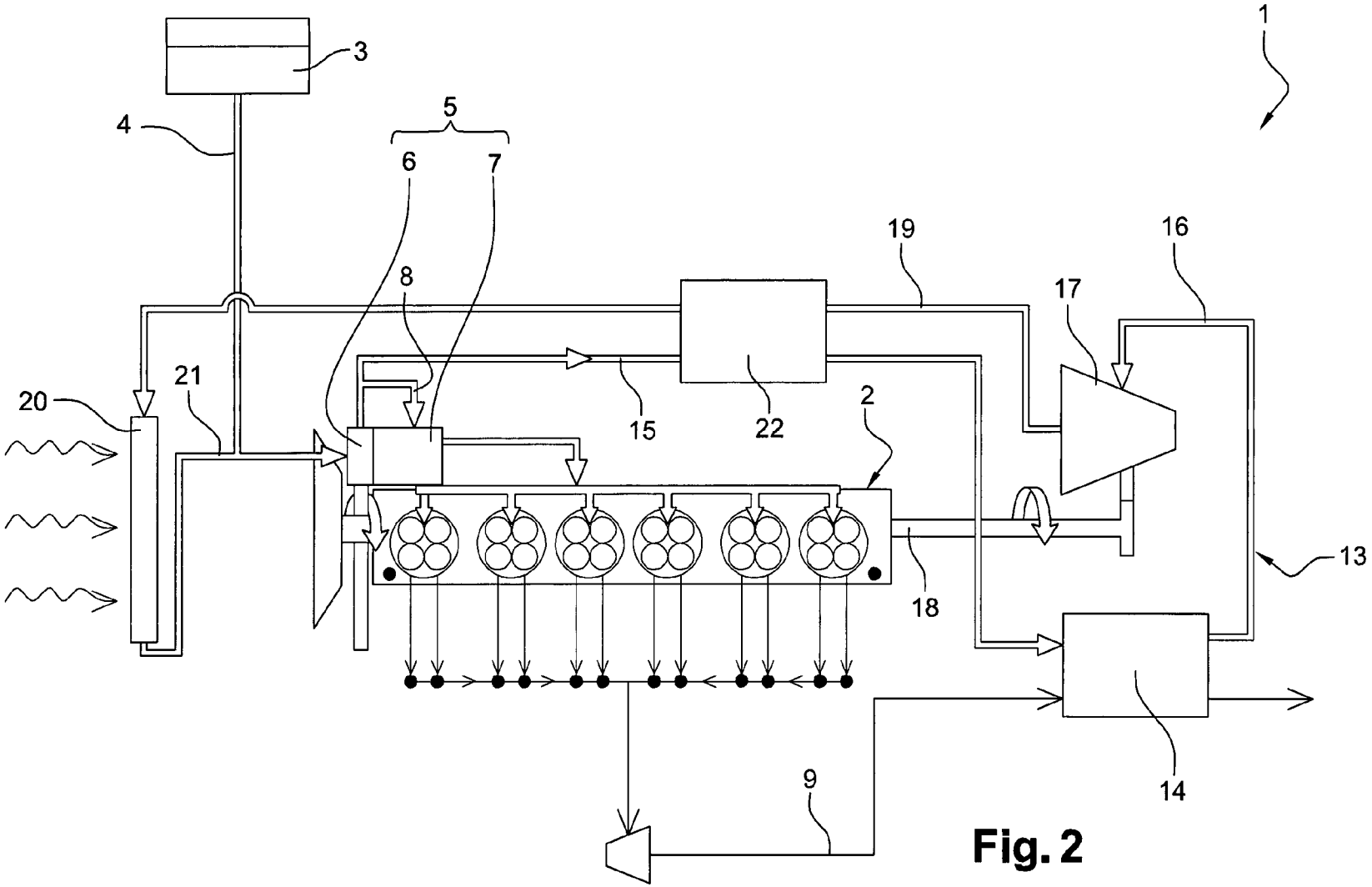
FIG. 2 is a schematic drawing of a second embodiment of an engine arrangement according to the invention.

Reference is now made to FIG. 2 which illustrates a second embodiment of the invention (the coolant circuit is not shown on FIG. 2).

In this embodiment, the fuel flowing in the Rankine circuit 13 is evaporated in the evaporator 14 by the hot exhaust gases flowing in the exhaust line 9.

Furthermore, a heater 22 is provided in the Rankine circuit 13, downstream from the pump 6 and upstream from the evaporator 14, in order to preheat the fuel flowing in the Rankine circuit 13 before it enters the evaporator 14. The fuel is preheated by means of the fuel flowing in the third line 19 of the Rankine circuit 13, i.e. downstream from the turbine 17 and upstream from the condenser 20.

Of course, the invention is not restricted to the embodiment described above by way of non-limiting example, but on the contrary it encompasses all embodiments thereof.

Fuel is not the only combustion fluid contemplated in the context of the invention which could be used for the heat recovery cycle and for injecting in the combustion process. Indeed, in other engine arrangements, not only fuel or not only one fuel is injected in the combustion chambers. There may be other combustion fluids, i.e. fluids which are to be injected in the combustion chamber of the internal combustion engine, which are not premixed with the fuel and which may therefore have a dedicated fluid circuit equipped with a pump. It must be noted that the combustion fluids are not necessarily injected at the same time in the combustion chamber. Also, each fluid may or may not be injected directly in the combustion chamber.

For example, the combustions fluids might include fuel, either heat recovery compatible or not, and water, where water is used in the combustion/expansion process to benefit from the heat generated by the fuel combustion to vaporize and provide further expansion, and/or reduce raw engine emissions. In such a case, water could also be used in the heat recovery cycle and a common pump would pressurize a flow of water both for injecting in the combustion chamber and for circulating in the heat recovery circuit. Alternatively, as in the previous example, if the fuel is heat recovery compatible, for example based on methanol or ethanol, then the fuel could be used in the heat recovery cycle instead of the water.

In another example, it is known to run internal combustion engines on fuels such as dimethyl ether (DME) or on ammonia-water solutions, which both are compatible with heat recovery cycles and which would therefore allow implementing the invention. Another example is the case of dual fuel engines where a first fuel, containing methane, ethane, propane, butane or mixtures thereof, and a second fuel, such as gasoline or diesel fuel, are injected separately in the combustion chamber of a compression ignition engine, in such a case, the first fuel may be heat recovery compatible so that a common pump fix the first fuel could also be used for pumping.

The heat recovery circuit could be based on a different cycle than the Rankine cycle, either derived from the Rankine cycle, such as the Kalina cycle or the supercritical Rankine cycle, or entirely different such as the Brayton or Ericsson cycles.

The invention claimed is:

1. An engine arrangement comprising:

an internal combustion engine where a combustion chamber is supplied with at least one combustion fluid by means of at least one combustion fluid circuit comprising at least one combustion fluid pump;

a heat recovery circuit carrying a fluid in a loop, successively through at least a pump, an evaporator, an expander capable of generating power from the fluid expansion;

wherein the combustion fluid is used as the fluid in the heat recovery circuit and the combustion fluid pump is a common pump located in the heat recovery circuit to pressurize the combustion fluid in the heat recovery circuit, and wherein only part of the combustion fluid is supplied to the at least one combustion chamber, and another part of the combustion fluid is directed to the expander of the heat recovery circuit.

2. The engine, arrangement according to claim 1, wherein the heat recovery circuit further comprises pressure reducing means between the common pump and the evaporator.

3. The engine arrangement according to claim 1, wherein the combustion fluid which is used as the fluid in the heat recovery circuit comprises one of or a mixture of an alcohol such as methanol or ethanol;

a lower alkane amidst methane, ethane, propane or butane;

water dimethyl ether (DME)

ammonia-water solution.

4. The engine arrangement according, to claim 1, wherein the fluid flowing in the heat recovery circuit is evaporated in the evaporator by a hot fluid chosen among:

a coolant of the engine flowing, in a coolant circuit (10) downstream from the engine;

hot exhaust gases flowing in an exhaust line of the engine arrangement;

engine oil;

compressed intake air of the engine;

EGR (exhaust gas recirculation) gases.

5. The engine arrangement according to claim 1, wherein the expander in the heat recovery circuit is chosen among a turbine, a scroll, a screw and a piston.

6. The engine arrangement according to claim 1, wherein the heat recovery circuit further comprises a heater located downstream from the pump and upstream from the evaporator, the heater being designed to preheat the fluid flowing in the heat recovery circuit before it enters the evaporator by means of the fluid flowing, in the heat recovery circuit downstream from the expander and upstream from a condenser.

7. The engine arrangement according to claim 1, wherein it comprises means capable of recovering the energy produced by the heat recovery fluid expansion in the expander into mechanical energy on an engine crankshaft, into electricity and/or into hydraulic or pneumatic pressure.

8. The engine arrangement according to claim 1, wherein the heat recovery circuit further comprises a condenser downstream of the expander and upstream of the pump.

9. A vehicle comprising an engine arrangement according to claim 1.

10. The engine arrangement according to claim 1, wherein the another part of the combustion fluid that is directed to the expander of the heat recovery circuit does not flow through the combustion chamber.

11. A vehicle comprising an engine arrangement according to claim 10.

12. The engine arrangement according to claim 1, wherein the another part of the combustion fluid that is directed to the expander of the heat recover circuit flows through the evaporator of the heat recovery circuit downstream of the combustion fluid pump.

13. A vehicle comprising an engine arrangement according, to claim 12.

14. The engine arrangement according to claim 1, wherein the another part of the combustion fluid that is directed to the expander flows to the evaporator through a line that branches off from a line that carries combustion fluid from the combustion fluid pump to the combustion chamber.

15. A vehicle comprising an engine arrangement according to claim 14.

16. An engine arrangement comprising:

an internal combustion engine where a combustion chamber is supplied with at least one combustion fluid by means of at least one combustion fluid circuit comprising at one combustion fluid pump;

a heat recovery circuit carrying a fluid in a loop, successively through at least a pump, an evaporator, an expander capable of generating power from the fluid expansion;

wherein the combustion fluid is used as the fluid in the heat recovery circuit and in that the combustion fluid pump is a common pump located in the heat recovery circuit to pressurize the fluid in the heat recover circuit, wherein the combustion fluid circuit comprises a low pressure combustion fluid pump and a high pressure combustion fluid pump, the common pump being the low pressure combustion fluid pump.

17. The engine arrangement according, to claim 16, wherein the heat recovery circuit further comprises pressure reducing means between the common pump and the evaporator.

18. The engine arrangement according to claim 16, wherein the combustion fluid which is used as the fluid in the heat recovery circuit comprises one of or a mixture of an alcohol such as methanol or ethanol;

a lower alkane amidst methane, ethane, propane or butane;

water dimethyl ether (DME)

ammonia-water solution.

19. The engine arrangement according to claim 16, wherein the heat recovery circuit further comprises a heater located downstream from the pump and upstream from the evaporator, the heater being designed to preheat the fluid flowing in the heat recovery circuit before it enters the evaporator by means of the fluid flowing in the heat recovery circuit downstream from the expander and upstream from a condenser.

20. The engine arrangement according to claim 16, wherein the heat recovery circuit further comprises a condenser downstream of the expander and upstream of the pump.

21. A vehicle comprising an engine arrangement according to claim 16.

* * * * *

UNITED STATES PATENT AND TRADEMARK OFFICE

CERTIFICATE OF CORRECTION

PATENT NO. : 8,720,420 B2
APPLICATION NO. : 13/699735
DATED : May 13, 2014
INVENTOR(S) : Benoit Lombard It is certified that error appears in the above-identified patent and that said Letters Patent is hereby corrected as shown below:

Title page, item [75] Inventor's city name incorrectly spelled as "Lyons" and it should be spelled as --Lyon--.

Signed and Sealed this
Fifteenth Day of July, 2014

Michelle K. Lee

Michelle K. Lee
*Deputy Director of the United States Patent and Trademark Office*